US005740986A

United States Patent [19]

Seidensticker et al.

[11] Patent Number: 5,740,986

[45] Date of Patent: Apr. 21, 1998

[54] METHOD OF DETERMINING THE POSITION OF ROLL OF A ROLLING FLYING OBJECT

[75] Inventors: Jens L. Seidensticker, Bodman-Ludwigshafen; Wolfgang W. Kreuzer, Stockach, both of Germany

[73] Assignee: Oerlikon Contraves GmbH, Stockach, Germany

[21] Appl. No.: 647,809

[22] Filed: May 15, 1996

[30] Foreign Application Priority Data

Jun. 1, 1995 [DE] Germany ..... 195 20 115.9

[51] Int. Cl.[6] ..... F41G 7/00

[52] U.S. Cl. ..... 244/3.15

[58] Field of Search ..... 342/62; 244/3.11, 244/3.14, 3.15, 3.23, 3.2, 171

[56] References Cited

U.S. PATENT DOCUMENTS

| | | | |
|---|---|---|---|
| 3,860,199 | 1/1975 | Dunne | 244/3.13 |
| 4,328,938 | 5/1982 | Reisman et al. | 244/3.1 |
| 4,426,048 | 1/1984 | Mildren | 244/3.23 |
| 4,646,990 | 3/1987 | Cleveland, Jr. | 244/3.21 |
| 4,662,580 | 5/1987 | Nelson | 244/3.1 |
| 4,967,981 | 11/1990 | Yff | 244/3.21 |
| 5,067,674 | 11/1991 | Heyche et al. | 244/190 |
| 5,076,511 | 12/1991 | Stein et al. | 244/3.22 |
| 5,141,175 | 8/1992 | Harris | 244/3.25 |
| 5,340,056 | 8/1994 | Guelman et al. | 244/3.16 |

*Primary Examiner*—Michael J. Carone
*Assistant Examiner*—Christopher K. Montgomery
*Attorney, Agent, or Firm*—Bachman & LaPointe, P.C.

[57] ABSTRACT

The invention concerns a method of determining the position of roll of a rolling flying object, in particular for the guiding of a ballistically flying projectile/rocket with roll equalization. A field strength of the earth's magnetic field, in particular a field-strength vector, is used to determine the position of roll of the flying object.

1 Claim, 1 Drawing Sheet

METHOD OF DETERMINING THE POSITION OF ROLL OF A ROLLING FLYING OBJECT

BACKGROUND OF THE INVENTION

The present invention relates to a method for determining the position of roll of a rolling flying object, in particular for the guidance of a ballistically flying projectile/rocket with roll equalization.

In ballistically flying projectiles/rockets, as well as in other flying objects, the determination of the position of roll is of decisive importance insofar as subsequent guidance of these flying objects is to be effected during the mission. This is true, in particular, of the guidance of ballistically flying projectiles/rockets in connection with which the possibility of correction of the flight path is provided, as described for instance in P 44 01 315.9.

In the present case there are concerned predominantly flying objects the rotation of which around the axis of roll is particularly pronounced. The rotations around the other axes of the body (pitching and yawing) are very slight as compared with it. In this connection, it is assumed that at least one reference direction, such as the direction of the velocity vector of the flying object is known for instance by measurement. Furthermore flying objects with quasi-stable, i.e. slowly varying roll frequency, are considered, since only for this type of movement is a dependable determination of the position of roll possible by the method proposed here at other than individual times.

Up to now, positions of roll have been determined by position reference gyroscopes or other inertia-reference systems. These devices or systems are mechanical/optronic precision instruments and are therefore of corresponding expense.

The object of the present invention is to develop a method of the above-mentioned type by which a relatively accurate determination of the position of roll of the flying object is effected and which requires only a slight expense.

SUMMARY OF THE INVENTION

The foregoing object is achieved by way of the present invention wherein a field strength of the earth's magnetic field, in particular a field-strength vector, is used in order to determine the position of roll of the flying object.

This method is to be used for the guiding of a ballistically flying projectile/rocket with roll equalization. A field-strength vector of the earth's magnetic field is used as direction reference.

A magnetic-field sensor measures the component of the earth's magnetic field preferably in radial direction to the projectile/rocket. In this connection, there is found, as a function of the position of roll, an alternating sinusoidal course of a measured intensity the minima and maxima of which indicate that the direction of measurement is closest to the course-of the earth's magnetic field. The roll frequency is determined from the difference in time of the maxima/minima.

The place of the magnetic-field sensor is at the same time reference point for the position of roll.

The roll axis of the obedient flying object is approximated by the velocity vector. The direction of the velocity vector is known since it is either established as intended course still during the planning stage of the mission and stored in an evaluation computer, or it is measured during flight, for instance with NAVSTAR-GPS.

Another possibility for the referencing of the position of roll results from the scanning and ranging of the flying projectile/rocket by radar or laser. Since the irradiation of the projectile/rocket takes place from a known and determinable direction, the direction of the earth's magnetic field can thus be associated with the position of roll of the projectile/rocket. In this case, the direction of the velocity vector can be dispensed with.

The orienting of the field-strength vector is known in a pre-defined reference system and stored in an evaluation computer.

From the orientation of direction reference (for instance velocity vector) and field-strength vector, the position of roll of the projectile/rocket can be calculated for the times of maximum and minimum intensity. Between these times the position of roll is determined in advance by the roll frequency determined. By consideration of the system dead time, i.e. the time necessary for the evaluation, the accuracy of the determination of the position of roll is additionally increased.

Of course, the use of a plurality of magnetic-field sensors, whereby a more accurate determination of the position of roll is possible, also falls within the scope of the invention.

The case that the flight path of the projectile/rocket lies on a field line of the earth's magnetic field can be considered a unique exceptional case, particularly in connection with ballistically flying flying objects. In this exceptional case, a determination of the determination of the position of roll is not possible by this method, since, despite the rolling movement, no changes in field strength transverse to the flight path take place. This exceptional case can be avoided by proper planning of the mission. If it nevertheless occurs, it is automatically recognized by the method.

BRIEF DESCRIPTION OF THE DRAWINGS

Other advantages, features and details of the invention will become evident from the following description of preferred embodiments and by reference to the drawing, in which.

DETAILED DESCRIPTION

Figure 1:
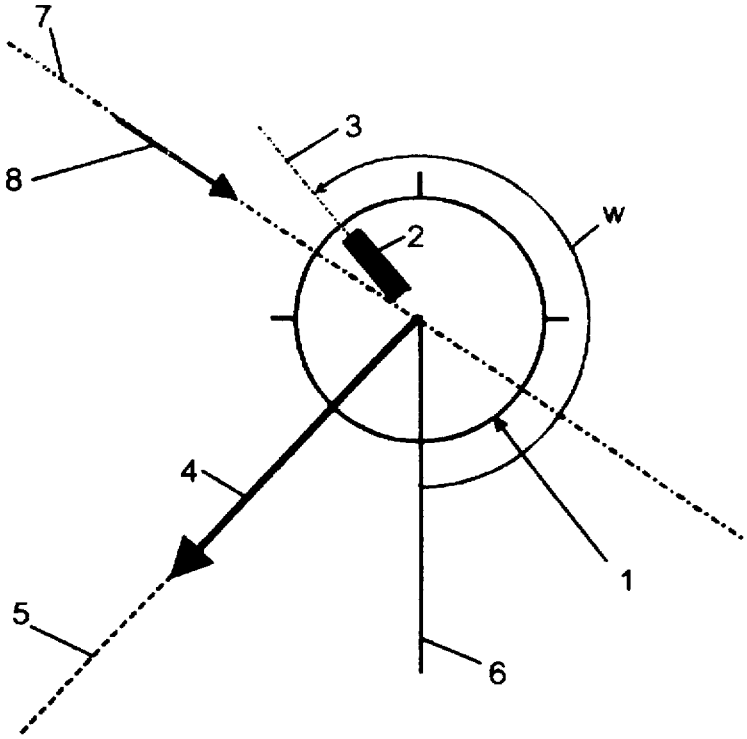
FIG. 1 is a diagrammatic showing of the relationship between a flying body and the earth's magnetic field.

FIG. 1 diagrammatically shows a flying object 1 having a magnetic-field sensor 2 and a measurement axis 3. This flying object has a velocity vector 4 and a roll axis 5. The arrow w represents the angle of roll of the flying object 1 with respect to a vertical reference axis (VRA) 6. A field line 7 of the earth's magnetic field with a field-strength vessel 8 is shown in dashed line.

The position of roll of the flying object 1 is determined on the basis of the field-strength vector 8, the velocity vector 4 of the flying object being known.

Figure 2:
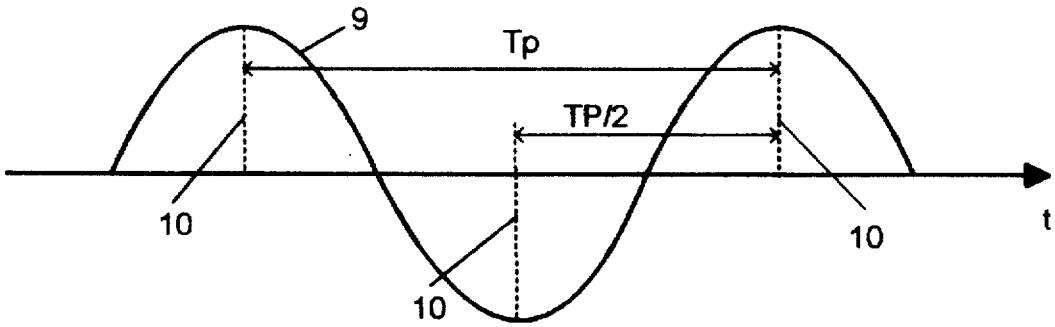
FIG. 2 is a diagrammatic showing of the method of the invention for the determination of the position of roll of a flying object.

The manner of operation of the present method is as follows:

As a result of the rolling movement of the flying object 1, the magnetic-field sensor 2 senses, with respect to its measurement axis 3, an alternating, sinusoidal change of the intensity of the magnetic field. This change is shown in FIG. 2 as a function plotted against the time t.

The decisive factor for the evaluation is alone the qualitative course of the measurement signal 9 with its pronounced maxima and minima as well as the times 10 corresponding to this maxima/minima.

A time difference Tp between two maxima or two minima is the duration of one roll rotation of the projectile/rocket. The roll frequency is determined from this.

The velocity of the flying object 1 is determined independently of the present method. This is done, for instance, by NAVSTAR-GPS (Global Positioning System), by means of which position values of the projectile/rocket and also velocity are determined.

In addition to position and velocity of the flying object 1, the direction of the VRA 6 in a pre-defined and referenced system is also known. The method utilizes the velocity vector 4 as approximation for the roll axis 5 of the flying object 1.

Roll axis 5, VRA 6, and field-strength vector 8 permit the determination of the position of roll of a reference point, for instance place of the magnetic-field sensor 2 at the time when the measurement axis 3 is in maximum agreement with the field line 7. Between these times, the angle of roll w is calculated in advance, namely from roll frequency and time interval since the last reference measurement.

We claim:

1. A method for determining the position of roll of a flying object where the velocity, position and vertical reference axis (VRA) of the flying object is known, comprising the steps of:

locating a magnetic field sensor in the flying object, the magnetic field sensor having a measurement axis with respect to the earth's magnetic field;

measuring with the magnetic field sensor the strength of the earth's magnetic field over time to generate a sinusoidal curve of the intensity of the magnetic field over time;

calculating the time interval (Tp) between maximum intensities of the measured magnetic field from the sinusoidal curve to determine roll frequency of the flying object; and calculating the angle of roll of the flying object with respect to the known vertical reference axis (VRA) as a function of the roll frequency and time interval (Tp) so as to determine the position of roll of the flying object.

* * * * *